US010448772B1

(12) United States Patent
Fiore

(10) Patent No.: US 10,448,772 B1
(45) Date of Patent: Oct. 22, 2019

(54) MAILBOX PROTECTOR

(71) Applicant: Judith Fiore, Richfield, OH (US)

(72) Inventor: Judith Fiore, Richfield, OH (US)

( * ) Notice: Subject to any disclaimer, the term of this patent is extended or adjusted under 35 U.S.C. 154(b) by 0 days.

(21) Appl. No.: 16/001,150

(22) Filed: Jun. 6, 2018

(51) Int. Cl.
*A47G 29/12* (2006.01)
*A47G 29/122* (2006.01)
*E01F 7/00* (2006.01)

(52) U.S. Cl.
CPC ..... *A47G 29/1216* (2013.01); *A47G 29/122* (2013.01); *E01F 7/00* (2013.01)

(58) Field of Classification Search
CPC ..... A47G 29/1216; A47G 29/122; A47G 29/1209; A47G 5/00; E01F 7/00; E01F 7/02; E01F 13/02; E04H 1/1244
USPC ..... 232/39, 38, 17; 40/606.06; 404/6; 256/12.5; 135/115; 160/135, 351
See application file for complete search history.

(56) References Cited

U.S. PATENT DOCUMENTS 3,605,851 A * 9/1971 Miles et al. ..... A47G 5/00 160/135
4,130,239 A 12/1978 Belsheim
4,187,978 A 2/1980 Dowker
4,875,622 A 10/1989 Lents
4,995,576 A 2/1991 Kieswetter
5,361,977 A 11/1994 Ogrodnick, Jr.
5,425,501 A 6/1995 Wesorick
5,460,326 A 10/1995 Albanesius
5,524,853 A 6/1996 Varlaro
6,308,884 B1 10/2001 Hamburger
6,962,460 B1 11/2005 Pratt
6,974,073 B1 12/2005 Snyder
7,080,773 B1 * 7/2006 Tepley ..... A47G 29/1216 232/17
7,353,985 B1 4/2008 Weatherholt, II
7,364,066 B1 4/2008 Wilson
7,611,043 B2 11/2009 Black
7,611,044 B1 11/2009 Wilson
8,123,113 B1 2/2012 Hartman
8,794,505 B1 8/2014 Richardson
8,925,225 B2 * 1/2015 Fiore ..... A47G 29/1216 232/39
9,549,632 B2 1/2017 Pickens
9,980,593 B2 * 5/2018 Pajonas ..... A47G 29/1209
2006/0186188 A1 8/2006 Belanger
2007/0138249 A1 6/2007 Webber
2010/0243977 A1 9/2010 Middlebrook, Jr.
2013/0232834 A1 * 9/2013 Fiore ..... A47G 29/122 40/606.03

* cited by examiner

*Primary Examiner* — William L Miller
(74) *Attorney, Agent, or Firm* — Dominic A. Frisina

(57) ABSTRACT

A mailbox protection device is provided. The device may include an angular deflection surface. The angular deflection surface may include a first planar deflection panel and a second planar deflection panel contiguous along a linear vertex. The linear vertex may be directed toward, for example, oncoming traffic to deflect impacting snow away from a mailbox. The impacting snow may come from passing snowplows, for instance. The device may also include a receiving channel. The receiving channel can be defined in the linear vertex extending through the device from an opening at a top end of the linear vertex to an opening at a bottom end of the linear vertex. The receiving channel may receivably cooperate with a known fence post to anchor the device in the ground.

18 Claims, 7 Drawing Sheets

MAILBOX PROTECTOR

I. BACKGROUND OF THE INVENTION

A. Field of Invention

Embodiments may generally relate to the field of devices for protecting roadside mailboxes from impact damage.

B. Description of the Related Art

Roadside mailboxes are well-known to be prone to damage by snowplows. Generally, damage tends to occur when a passing snowplow throws snow and entrained debris, e.g. gravel or broken asphalt, at the mailbox causing impact damage. Even if no damage occurs the mailbox tends to be covered with snow. Consequently, a number of devices exist to address this issue, but all have certain shortcomings. For instance, one well-known solution is to place a make-shift shield next to the mailbox, often made from materials like plywood and wooden posts. While common, this solution has aesthetic deficiencies and often a short life as they tend to warp and rot. Another solution is to design the mailbox itself so that it is more aerodynamic, thereby allowing impacting snow to be deflected away. Still another solution is to build a sturdy structure around the mailbox, like a brick encasement. One known device is an angular shield composed of two planar members joined by braces to form a wedge shape. This device is fixed to the ground with stakes but leaves the device otherwise unreinforced against impact.

What is needed is a device that provides an angular surface for deflecting snow, as well as a means for supporting the device against the force of impact. Some embodiments of the present invention may provide one or more benefits or advantages over the prior art.

II. SUMMARY OF THE INVENTION

Some embodiments may relate to a mailbox protection device. The device may comprise an angular deflection surface defined by a first planar deflection panel and a second planar deflection panel contiguous along a linear vertex. The device may further comprise a receiving channel defined in the linear vertex extending from a top opening at a top end of the linear vertex to a bottom opening at a bottom end of the linear vertex.

Some embodiments may further comprise a top panel contiguous with the first planar deflection panel and the second planar deflection panel.

According to some embodiments the first planar deflection panel and the second planar deflection panel subtend an angle between 70° and 110°.

According to some embodiments the top opening and the bottom opening are receivably co-operable with a standard steel tee fence post.

According to some embodiments the top opening and the bottom opening are keyed to receive the standard steel tee fence post in a preferred orientation wherein the base of the tee is directed toward the linear vertex.

Some embodiments may further comprise a first vertical support rib disposed at an outer edge of the first planar deflection panel, and a second vertical support rib disposed at an outer edge of the second planar deflection panel.

Some embodiments may further comprise a first upper horizontal support rib disposed on an outward face of the first planar deflection panel, and a second upper horizontal support rib disposed on an outward face of the second planar deflection panel.

Some embodiments may further comprise a first lower horizontal support rib disposed on an outward face of the first planar deflection panel, and a second lower horizontal support rib disposed on an outward face of the second planar deflection panel.

Some embodiments may further comprise a first top horizontal support rib disposed on an outward face of the top panel.

According to some embodiments the receiving channel further comprises an integral post-receiving upper bracket, and an integral post-receiving lower bracket.

Some embodiments may further comprise a first fastening aperture disposed at an outer portion of a bottom flange of the first planar deflection panel, and a second fastening aperture disposed at an outer portion of a bottom flange of the second planar deflection panel.

Other benefits and advantages will become apparent to those skilled in the art to which it pertains upon reading and understanding of the following detailed specification.

III. BRIEF DESCRIPTION OF THE DRAWINGS

The invention may take physical form in certain parts and arrangement of parts, embodiments of which will be described in detail in this specification and illustrated in the accompanying drawings which form a part hereof, wherein like reference numerals indicate like structure, and wherein.

IV. DETAILED DESCRIPTION OF THE INVENTION

Figure 1A:
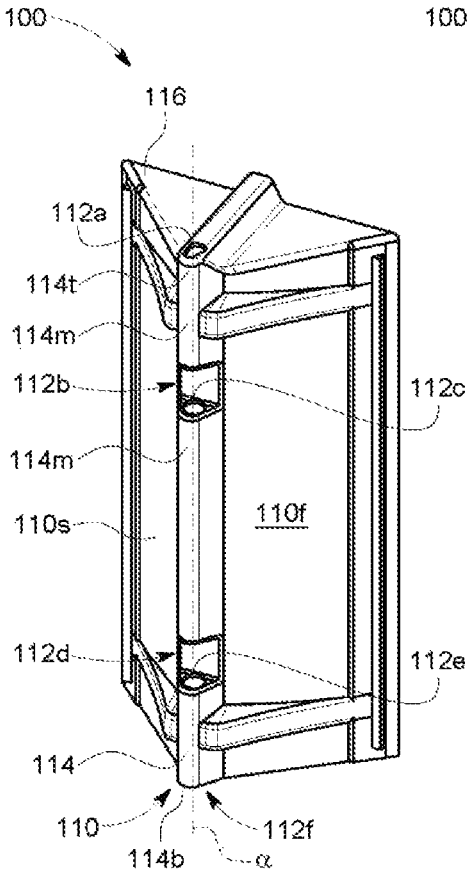
FIG. 1A is a perspective view of an embodiment.

As used herein the terms "embodiment", "embodiments", "some embodiments", "other embodiments" and so on are not exclusive of one another. Except where there is an explicit statement to the contrary, all descriptions of the features and elements of the various embodiments disclosed herein may be combined in all operable combinations thereof.

Language used herein to describe process steps may include words such as "then" which suggest an order of operations; however, one skilled in the art will appreciate that the use of such terms is often a matter of convenience and does not necessarily limit the process being described to a particular order of steps.

Conjunctions and combinations of conjunctions (e.g. "and/or") are used herein when reciting elements and characteristics of embodiments; however, unless specifically stated to the contrary or required by context, "and", "or" and "and/or" are interchangeable and do not necessarily require every element of a list or only one element of a list to the exclusion of others.

Reference may be made herein to terms indicating an orientation of parts of an embodiment. Such terms are used as a matter of convenience and are not intended to limit the invention particular orientations, or modes of use. Their meaning will be clear from context, but generally orientation is judged from the perspective of the device rather than the observer.

Terms of degree, terms of approximation, and/or subjective terms may be used herein to describe certain features or elements of the invention. In each case sufficient disclosure is provided to inform the person having ordinary skill in the art in accordance with the written description requirement and the definiteness requirement of 35 U.S.C. 112.

Referring now to the drawings wherein the showings are for purposes of illustrating embodiments of the invention only and not for purposes of limiting the same, FIG. 1 illustrates an embodiment 100 having an angular deflection surface 110. The angular deflection surface 110 includes a first planar deflection panel 110*f* and a second planar deflection panel 110*s*. The first and second panels 110*f*, 110*s* are contiguous along a linear vertex 114. As used throughout specification and claims, the term contiguous is intended only to indicate position without regard to whether components are continuous or unitary, or whether they are discrete parts that have been joined.

According to the illustrated embodiment the linear vertex 114 is a region where the first and second deflection panels meet. The person having ordinary skill in the art will appreciate that while the mathematical term vertex denotes a one-dimensional form, having no width, the component referred to herein as linear vertex 114 is a physical structure rather than a mathematical abstraction. Accordingly, it necessarily has width.

Suitable linear vertices within the scope of the present invention may comprise an arcuate surface, i.e. a rounded corner, defining a non-zero radius of curvature. Moreover, suitable vertices may define radii sufficiently large to receivably cooperate 130 with a predetermined post 120 for mounting the device 100 in the ground next to a roadside mailbox. Particularly, FIG. 1B illustrates an opening 112*a* at the top end 114*t* of the linear vertex 114 where the opening 112*a* and vertex 114 are suitably dimensioned to receivably cooperate 130 with a well-known tee post 120. Opening 112*a* of FIGS. 1A and 1B is additionally shaped so that it cooperates with the tee post 120 in only one predetermined orientation, namely, with the leg member 122 of the tee pointing toward the linear vertex 114 and the base member 124 of the tee facing away from the linear vertex 114.

With continuing reference to FIG. 1B, the person having ordinary skill in the art will readily appreciate that the illustrated orientation of the post 120 to the embodiment 100 is a matter of convenience and not a limitation of the invention. Other shapes of opening 112*a*, and other relative orientations of post 120 and embodiment 100 may also be suitable. A benefit of shaping opening 112*a* to accommodate post 120 in a predetermined orientation is that doing so fixes the orientation of the embodiment 100 relative to the structures that it is designed to protect, namely roadside mailboxes 200 as shown in FIG. 2. Thus, any predetermined fixed relative orientation of the post 120 to the embodiment 100 would enable a user to install the post 120 and embodiment 100 in a protective orientation relative to roadside mailboxes 200. The ordinarily skilled artisan will readily appreciate that a protective orientation is one that is effective to deflect impacting snow from, for instance, a passing snowplow. Normally, a protective orientation directs the linear vertex 114 toward oncoming traffic.

Figure 1B:
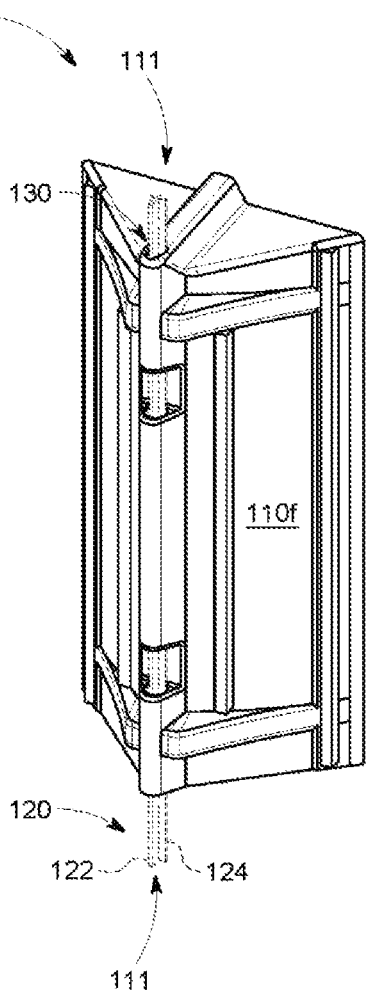
FIG. 1B is a perspective view of the embodiment of FIG. 1A receiving a known fence post.
Figure 2:
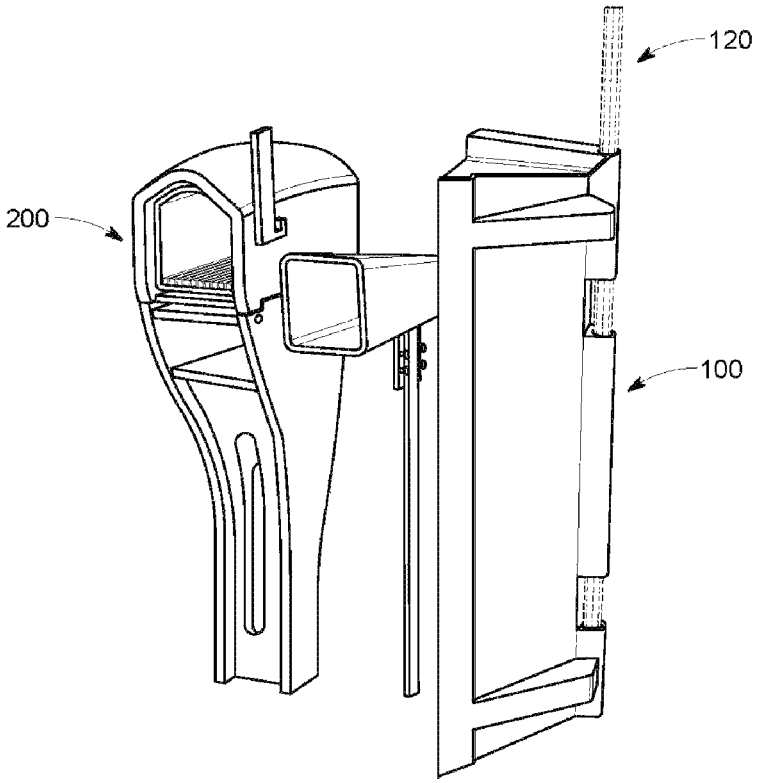
FIG. 2 is a view of an embodiment functionally installed next to mailboxes which it is protecting from impact.

With continuing regard to FIGS. 1A and 1B, additional openings in the linear vertex 114 include 112*b*, 112*c*, 112*d*, 112*e*, and 112*f* (out of view), which all share a common central axis a. Openings 112*a* through 112*f* receivably cooperate 130 with the tee post 120 collectively defining a receiving channel 111. The receiving channel 111 is defined by the openings 112*a* through 112*f* in the embodiment along the linear vertex 114.

Unlike opening 112*a*, openings 112*b* through 112*e* are larger circular openings, whereas openings 112*a* and 112*f* (not visible) are shaped, or keyed, to receivably cooperate with a predetermined post structure in a preferred orientation. The ordinarily skilled artisan will appreciate that while shaping one or more of the openings 112*a-f* to accommodate the tee post in a preferred or predetermined orientation may have certain advantages, this is not a requirement of the invention. Any arrangement that cooperates with a post to provide strength to the embodiment would be sufficient. Furthermore, while the illustrated embodiment provides sufficient strength with six openings, other embodiments may include only two, e.g. the topmost 112*a* and the bottommost 112*f*. Moreover, the openings (e.g. 112*a* and 112*f*) may or may not be keyed to receivably cooperate with a post structure in a predetermined orientation.

In view of the described variations in the structure of openings 112*a* and 112*f*, and the structural variations between openings 112*a*, 112*f* and openings 112*b* through 112*e*, the term "receivably cooperate" 130 may indicate a plurality of conditions. For example, openings 112*a* and 112*f* may receivably cooperate with a tee-post 120 when they receive the tee-post in a preferred orientation. However, openings 112*b* through 112*e* may receivably cooperate when they merely receive the tee-post 120 without regard to orientation. Similarly, in embodiments where openings 112*a* and 112*f* are not keyed, but rather are circular like 112*b* through 112*e*, they would receivably cooperate with post 120 when they merely receive the tee-post without regard to orientation. Accordingly, depending on the structure of the embodiment "receivably cooperate" may or may not include a preferred fixed relative orientation between the post 120 and the embodiment 100.

The term linear vertex 114 may indicate the entire arcuate transitional area between the first and second deflection panels 110*f*, 110*s*. However, the invention is not limited in this way. Embodiments may also include linear vertices defining sharp rather than arcuate transitions. The linear vertex 114 illustrated in FIG. 1A, being arcuate and suitably dimensioned, cooperates in defining a receiving channel 111. With reference to both FIGS. 1A and 1B, the receiving channel 111 receivably cooperates 130 with a post such as the illustrated tee-post 120. Accordingly, when snow thrown from a passing snowplow, for example, impacts the embodiment 100 the force is largely transferred through the receiving channel 111 to the post 120. The deflection panels 110*f*, 110*s* divert the path of the impacting snow away from the embodiment 100.

The linear vertex 114 of FIGS. 1A and 1B is divided into a top end 114*t* a middle 114*m*, and a bottom end 114*b*. As such, the post 120 is exposed to impacting snow, and flat surfaces 115U, 115L behind the post 120 are also created. This may tend to diminish the energy dissipative properties of the angular deflection surface 110, but it is contemplated to be a tolerable diminishment having no practical effect on the efficacy or strength of the embodiment 100. The ordinarily skilled artisan will appreciate that, alternatively, the linear apex 114 may extend continuously and unbroken from the top of the embodiment 100 to the bottom, thus shielding the post 120 from impacting snow and further improving the energy dissipative properties of the angular deflection surface. However, the illustrated embodiment provides certain advantages with respect to manufacturing and shipping because it enables one to make the device according to well-known vacuum forming methods. Though not limited to vacuum forming, such methods are inexpensive relative to other modes of plastic molding. Moreover, vacuum formed embodiments are readily stackable thereby reducing shipping costs.

Figure 3A:
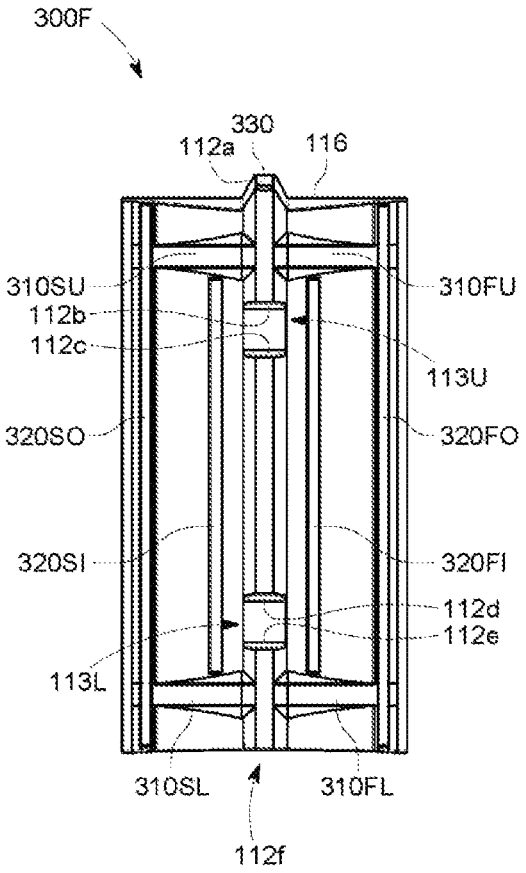
FIG. 3A is a front view of the embodiment of FIG. 1A.

Turning to FIG. 3A, a front view of the embodiment 100 is illustrated showing a front surface 300F. The device includes a first upper horizontal support rib 310FU, and a second upper horizontal support rib 310SU. Similarly, the device includes a first lower horizontal support rib 310FL and a second lower horizontal support rib 310SL. The horizontal support ribs 310FU, 310SU, 310FL, and 310SL tend to prevent bowing of the embodiment in horizontal directions. Similarly, embodiments may include one or more pairs of vertical support ribs to provide support in vertical directions.

Figure 3B:
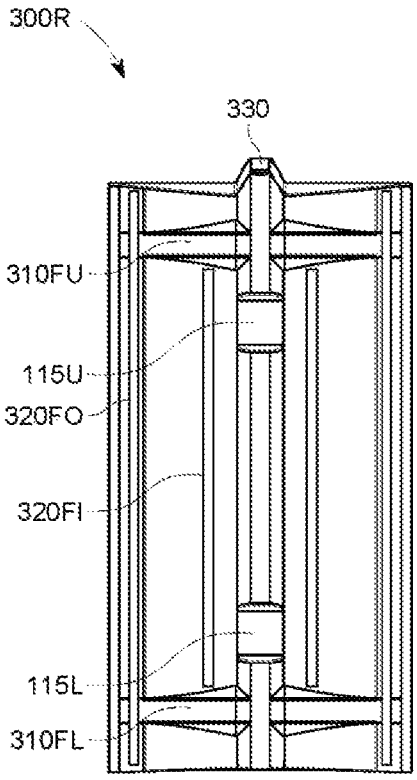
FIG. 3B is a rear view of the embodiment of FIG. 1A.

As shown in FIGS. 3A and 3B, a first outer vertical support rib 320FO and a first inner vertical support rib 320FI are included on the first planar deflection panel 110*f*. Likewise, a second outer vertical support rib 320SO and a second inner vertical support rib 320SI are included on the second planar deflection panel 110*s*. While vertical and horizontal support ribs may be desirable to prevent bowing, the ordinarily skilled artisan will appreciate that they are not required. Though bowing may be aesthetically unpleasing, it does not affect functionality or efficacy of embodiments. The ordinarily skilled artisan will readily understand whether to provide such support and, if so, where and how much support is necessary to provide the desired effect.

FIGS. 3A and 3B further illustrate certain structures of the receiving channel 111. Namely, upper and lower integral post receiving brackets are shown 113U, 113L. More specifically, the post receiving upper bracket 113U includes openings 112*b* and 112*c*, and upper back panel 115U. Likewise, the lower post receiving bracket 113L includes openings 112*d* and 112*e*, and lower back panel 115L. The post receiving brackets 113U, 113L are integral in the sense that they are different regions of the same continuous sheet structure. While this is a convenient arrangement in the illustrated embodiment, the skilled artisan will appreciate that a wide range of structures may serve the same post-receiving purpose, and are thus within the scope of the invention.

Finally, FIGS. 3A and 3B illustrate that the front surface 300F and the rear surface 300R of the embodiment 100 are mirror images of each other comprising opposite sides of the same structures. This mirror image relationship is the natural consequence of vacuum forming; again however, the present invention is not limited to vacuum forming, and the front surface 300F and the rear surface 300R need not be mirror images of each other. With continuing reference to FIGS. 3A and 3B, a top panel 116 is shown contiguous with the first and second planar deflection panels 110F, 110S. Although the top panel 116 is not a necessary element of the invention it provides certain benefits including that it tends to fix the angle of subtended by the first and second planar deflection surfaces 110F, 110S thus providing a structurally more robust embodiment. The top panel 116 also includes a top horizontal support rib 330 which, like the other support ribs, tends to prevent or mitigate bowing.

Figure 4A:
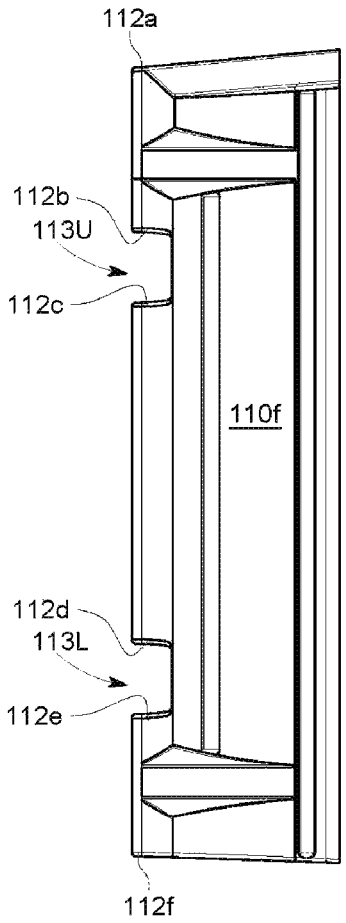
FIG. 4A is a left-side view of the embodiment of FIG. 1A.
Figure 4B:
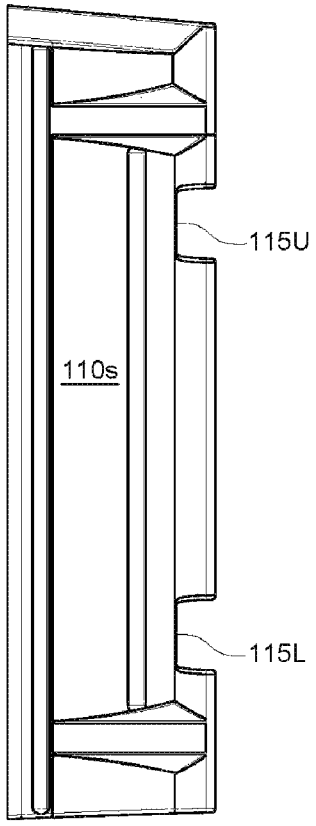
FIG. 4B is a right-side view of the embodiment of FIG. 1A.

FIGS. 4A and 4B are first and second side views of the embodiment 100 respectively. These two figures further illustrate the device's symmetry, the placement of support ribs, and the components of the upper and lower integral post receiving brackets 113U, 113L.

Figure 5A:
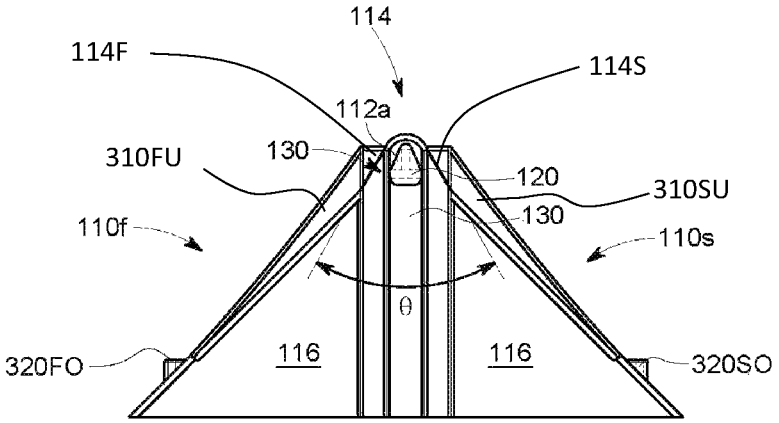
FIG. 5A is a top view of the embodiment of FIG. 1A.
Figure 5B:
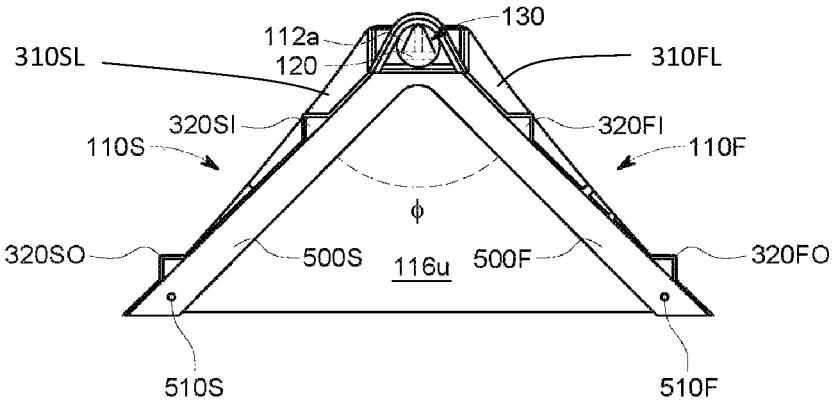
FIG. 5B is a bottom view of the embodiment of FIG. 1A.

FIG. 5A is a top view of the embodiment 100 showing the top panel 116 contiguous with the first and second planar deflection panels 110*f*, 110*s*. FIG. 5B shows the bottom of the embodiment 100. From this perspective the underside 116*u* of the top panel 116 is visible. Angle is the angle subtended by first and second lateral walls 114F, 114S of the linear vertex 114 The lateral walls 114F, 114S of the illustrated embodiment 100 are flat rather than curved, and run tangent to the curvature of the linear vertex 114. The value of this angle is non-critical but is advantageously less than that of angle ϕ. Angle ϕ indicates the angle subtended by the first and second planar deflection panels 110F, 110S. The specific value of ϕ is non-critical, but may conveniently be around 90 degrees +/−20 degrees. The person having ordinary skill in the art will appreciate that certain advantages may be realized by making angle less than angle ϕ. Specifically, this arrangement may tend to more efficiently cut through impacting snow. Angle may advantageously be around 60 degrees +/−20 degrees.

Figure 6A:
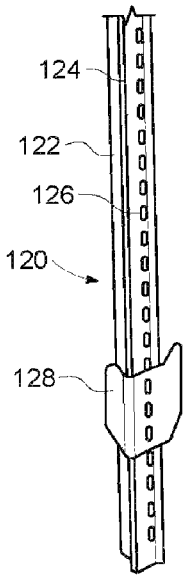
FIG. 6A (PRIOR ART)
FIG. 6A is a perspective view of a known tee fence post.
Figure 6B:
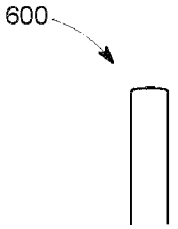
FIG. 6B (PRIOR ART)
FIG. 6B is a drawing of a known U-stake.
Figure 7A:
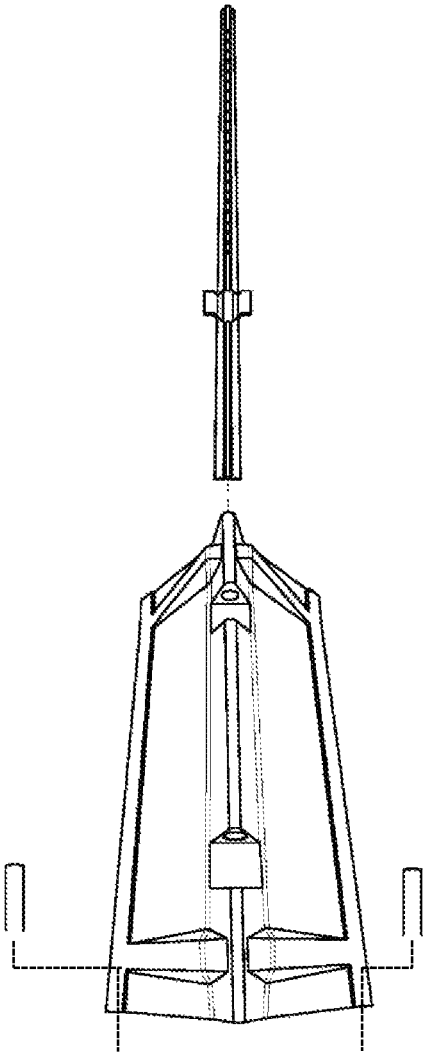
FIG. 7A is an exploded view of an embodiment along with installation hardware.

Also shown in FIG. 5B are optional first and second fastening apertures 510F, 510S which are sized to receive tines of well-known U-stakes 600 (shown in FIGS. 6B and 7A). Though optional, U-stakes provide a means for fixing the embodiment 100 in place. Embodiments lacking keyed openings 112*a* and 112*f* may benefit from U-stakes to fix the rotational orientation of the device relative to roadside mailboxes 200 upon installation. U-stakes may also prevent lift-off of an embodiment from a post 120 under a strong wind, for example. The ordinarily skilled artisan will appreciate that the invention is not limited to U-stakes.

FIG. 6A illustrates a well-known fence post compatible with the present invention. Particularly, FIG. 6A illustrates a tee post. The "tee" referring to the longitudinal cross-sectional T-shape made by the base member 124 and the leg member 122. This type of fence post commonly includes teeth 126 making it difficult to pull from the ground once installed, and a plate 128 which tends to fix its rotational orientation upon installation. Accordingly, the post is difficult to twist and tends to remain facing in the direction in which it was installed. FIG. 6B illustrates a well-known U-stake, which is literally a U-shaped rod or wire having two tines. The stake is used with embodiment 100 by inserting both tines into the ground with one tine passing through a fastening aperture, i.e. 510F or 510S.

Figure 7B:
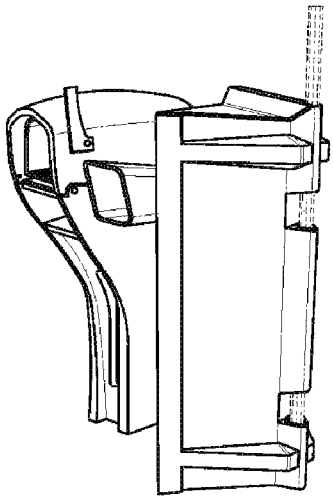
FIG. 7B illustrates the embodiment of FIG. 7A installed next to a roadside mailbox.

FIG. 7A shows the embodiment 100 in exploded view, illustrating its relation to the post 120 and U-stakes 600. FIG. 7B illustrates the embodiment 100 fully installed next to a pair of roadside mailboxes 200.

It will be apparent to those skilled in the art that the above methods and apparatuses may be changed or modified without departing from the general scope of the invention. The invention is intended to include all such modifications and alterations insofar as they come within the scope of the appended claims or the equivalents thereof.

The following list shows the correlation between the various reference numerals used in the appended drawings, and the elements of the drawings that they represent. This list is provided only for convenience and is not intended to be limiting in any way. Abbreviated, shortened, or otherwise somewhat different wording may be used herein to describe the same structures or drawing elements without obscuring their meaning to the person having ordinary skill in the art.

$\phi$ inside angle subtended by the first and second planar deflection panels inside angle tangent to curvature of vertex 114

$\alpha$ common central axis of openings 112*a* through 112*f*

100 mailbox protection device

110 angular deflection surface

110*f* first planar deflection panel

110*s* second planar deflection panel

111 receiving channel (combination of 112*a-f*)

112*a* top opening (receiving channel member)

112*b* first intermediate opening (receiving channel member)

112*c* second intermediate opening (receiving channel member)

112*d* third intermediate opening (receiving channel member)

112*e* fourth intermediate opening (receiving channel member)

112*f* bottom opening (receiving channel member)

113U integral post receiving upper bracket (includes 112*b*, 112*c*, and 115U)

113L integral post receiving lower bracket (includes 112*d*, 112*e*, and 115L)

114 linear vertex

114*t* top end of the linear vertex

114*m* middle of the linear vertex

114*b* bottom end of the linear vertex

114F first lateral wall of the linear vertex

114S second lateral wall of the linear vertex

115U upper bracket back-panel

115L lower bracket back-panel

116 top panel

116*u* underside of the top panel

120 tee fence post

122 leg member of the tee fence post

124 base member of the tee fence post

126 teeth

128 plate

130 top opening (112*a*) receivably cooperating with tee fence post (120)

132 bottom opening (112*f*) receivably cooperating with tee fence post (120)

200 road side mailboxes

300F front surface

300R rear surface

310SU upper horizontal support rib of the second planar deflection panel

310SL lower horizontal support rib of the second planar deflection panel

310FU upper horizontal support rib of the first planar deflection panel

310FL lower horizontal support rib of the first planar deflection panel

320SO outer vertical support rib of the second planar deflection panel

320SI Inner vertical support rib of the second planar deflection panel

320FO outer vertical support rib of the first planar deflection panel

320FI Inner vertical support rib of the first planar deflection panel

330 top horizontal support rib of the top panel

510F first fastening aperture

510S second fastening aperture

600 U-stake

I claim:

1. A mailbox protection device, comprising:

an angular deflection surface defined by a first planar deflection panel and a second planar deflection panel contiguous along a linear vertex;

a receiving channel defined in the linear vertex extending from a top opening at a top end of the linear vertex to a bottom opening at a bottom end of the linear vertex;

the top opening and the bottom opening are receivably co-operable with a steel tee fence post; and the top opening and the bottom opening are keyed to receive the steel tee fence post in a preferred orientation wherein a leg member of the steel tee fence post points toward the linear vertex.

2. The device of claim 1, further comprising a top panel contiguous with the first planar deflection panel and the second planar deflection panel.

3. The device of claim 2, further comprising a first top horizontal support rib disposed on an outward face of the top panel.

4. The device of claim 1 wherein the first planar deflection panel and the second planar deflection panel subtend an angle between 70° and 110°.

5. The device of claim 1, further comprising a first vertical support rib disposed at an outer edge of the first planar deflection panel, and a second vertical support rib disposed at an outer edge of the second planar deflection panel.

6. The device of claim 1, further comprising a first upper horizontal support rib disposed on an outward face of the first planar deflection panel, and a second upper horizontal support rib disposed on an outward face of the second planar deflection panel.

7. The device of claim 6, further comprising a first lower horizontal support rib disposed on an outward face of the first planar deflection panel, and a second lower horizontal support rib disposed on an outward face of the second planar deflection panel.

8. The device of claim 1, wherein the receiving channel further comprises an integral post-receiving upper bracket, and an integral post-receiving lower bracket.

9. The device of claim 1, further comprising a first fastening aperture disposed at an outer portion of a bottom flange of the first planar deflection panel, and a second fastening aperture disposed at an outer portion of a bottom flange of the second planar deflection panel.

10. A mailbox protection device, comprising:

a first planar deflection panel defining a generally rectangular shape having a top edge, a bottom edge, a free lateral edge, and a vertex lateral edge;

a second planar deflection panel defining a generally rectangular shape having a top edge, a bottom edge, a free lateral edge, and a vertex lateral edge, wherein the first planar deflection panel and the second planar deflection panel are contiguous along their vertex lateral edges;

a top panel contiguous with the first planar deflection panel and the second planar deflection panel;

a linear deflection vertex defined by the vertex lateral edges of the first planar deflection panel and the second planar deflection panel;

a top opening defined in a top end of the linear deflection vertex, wherein the top opening is keyed to receive a fence post only in a predetermined orientation; and a bottom opening defined in a bottom end of the linear deflection vertex, wherein the bottom opening is keyed to receive the fence post only in a predetermined orientation.

11. The device of claim 10, further comprising:

a first bottom flange contiguous with the first planar deflection panel; and a second bottom flange contiguous with the second planar deflection panel.

12. The device of claim 11, further comprising:

a first fastening aperture defined in the first bottom flange;

a second fastening aperture defined in the second bottom flange, wherein the first and second fastening apertures are sized to cooperate with a predetermined stake.

13. The device of claim 10, wherein the first planar deflection panel and the second planar deflection panel subtend and angle between 70° and 110°.

14. The device of claim 10, wherein the top opening and the bottom opening define opposing ends of a receiving channel defined in the linear vertex.

15. The device of claim 14, wherein the receiving channel further comprises at least one integral post-receiving bracket.

16. A mailbox protection device, comprising:

a first planar deflection panel defining a generally rectangular shape having a top edge, a bottom edge, a free lateral edge, and a vertex lateral edge;

a second planar deflection panel defining a generally rectangular shape having a top edge, a bottom edge, a free lateral edge, and a vertex lateral edge, wherein the first planar deflection panel and the second planar deflection panel are contiguous along their vertex lateral edges, and wherein the first planar deflection panel and the second planar deflection panel subtend and angle between 70° and 110°;

a top panel contiguous with the first planar deflection panel and the second planar deflection panel;

a linear deflection vertex defined by the vertex lateral edges of the first planar deflection panel and the second planar deflection panel;

a top opening defined in a top end of the linear deflection vertex, wherein the top opening is keyed to receive a fence post only in a predetermined orientation;

a bottom opening defined in a bottom end of the linear deflection vertex, wherein the bottom opening is keyed to receive the fence post only in a predetermined orientation;

a first bottom flange contiguous with the first planar deflection panel, wherein the first bottom flange comprises a first fastening aperture; and a second bottom flange contiguous with the second planar deflection panel, wherein the second bottom flange comprises a second fastening aperture.

17. The device of claim 16, wherein the top opening and the bottom opening define opposing ends of a receiving channel defined in the linear vertex.

18. The device of claim 17, wherein the receiving channel further comprises at least one integral post-receiving bracket.

* * * * *